United States Patent [19]

Hinzpeter

[11] Patent Number: 4,999,151

[45] Date of Patent: Mar. 12, 1991

[54] METHOD OF QUALITY ASSURANCE IN THE MANUFACTURE OF TABLETS

[75] Inventor: Jurgen Hinzpeter, Schwarzenbek, Fed. Rep. of Germany

[73] Assignee: Firma Wilhelm Fette GmbH, Schwarzenbek, Fed. Rep. of Germany

[21] Appl. No.: 420,709

[22] Filed: Oct. 12, 1989

Related U.S. Application Data

[63] Continuation-in-part of Ser. No. 88,815, Aug. 24, 1987, abandoned.

[30] Foreign Application Priority Data

Aug. 23, 1986 [DE] Fed. Rep. of Germany ..... 3628757

[51] Int. Cl.[5] ..... B29C 43/08; B30B 11/08

[52] U.S. Cl. ..... 264/40.4; 264/123; 425/140; 425/354

[58] Field of Search ..... 264/40.1, 40.4, 40.5, 264/109, 123; 425/140, 149, 354

[56] References Cited

U.S. PATENT DOCUMENTS

| | | | |
|---|---|---|---|
| 3,255,716 | 6/1966 | Knoechel et al. | 264/40.4 |
| 3,910,737 | 10/1975 | Shimada et al. | 264/40.4 |
| 4,030,868 | 6/1977 | Williams | 264/40.4 |
| 4,452,579 | 6/1984 | Janson | 425/140 |

FOREIGN PATENT DOCUMENTS

| | | | |
|---|---|---|---|
| 0109600 | 8/1980 | Japan | 264/40.4 |
| 0072811 | 5/1982 | Japan | 264/40.4 |
| 0261697 | 12/1985 | Japan | 264/40.1 |

OTHER PUBLICATIONS

CRC Handbook of Tables for Probability and Statistics, pp. 333–337.

*Primary Examiner*—David A. Simmons
*Assistant Examiner*—Mary Lynn Fertig
*Attorney, Agent, or Firm*—Collard, Roe & Galgano

[57] ABSTRACT

A method for quality assurance in the manufacture of tablets. Tablet samples consisting of a plurality of tablets are taken whose actual weight is compared with their nominal weight, so that the tabletting machine is subsequently adjusted according to the deviation in order to adjust the weight of the tablets to the nominal weight. If the sample of tablets contains one or several tablets which, as so-called error tablets, show significant deviation from the nominal weight due to flawed manufacture, inaccuracy of the result so obtained is avoided if prior to adjustment of the machine, the weights of the individual sample tablets are measured and compared with one another. If it is found that the sample contains tablets with significant deviation from their nominal weight, such tablets may be taken into account in the statistical analysis by corrective computation.

4 Claims, 1 Drawing Sheet

METHOD OF QUALITY ASSURANCE IN THE MANUFACTURE OF TABLETS

Figure 1:
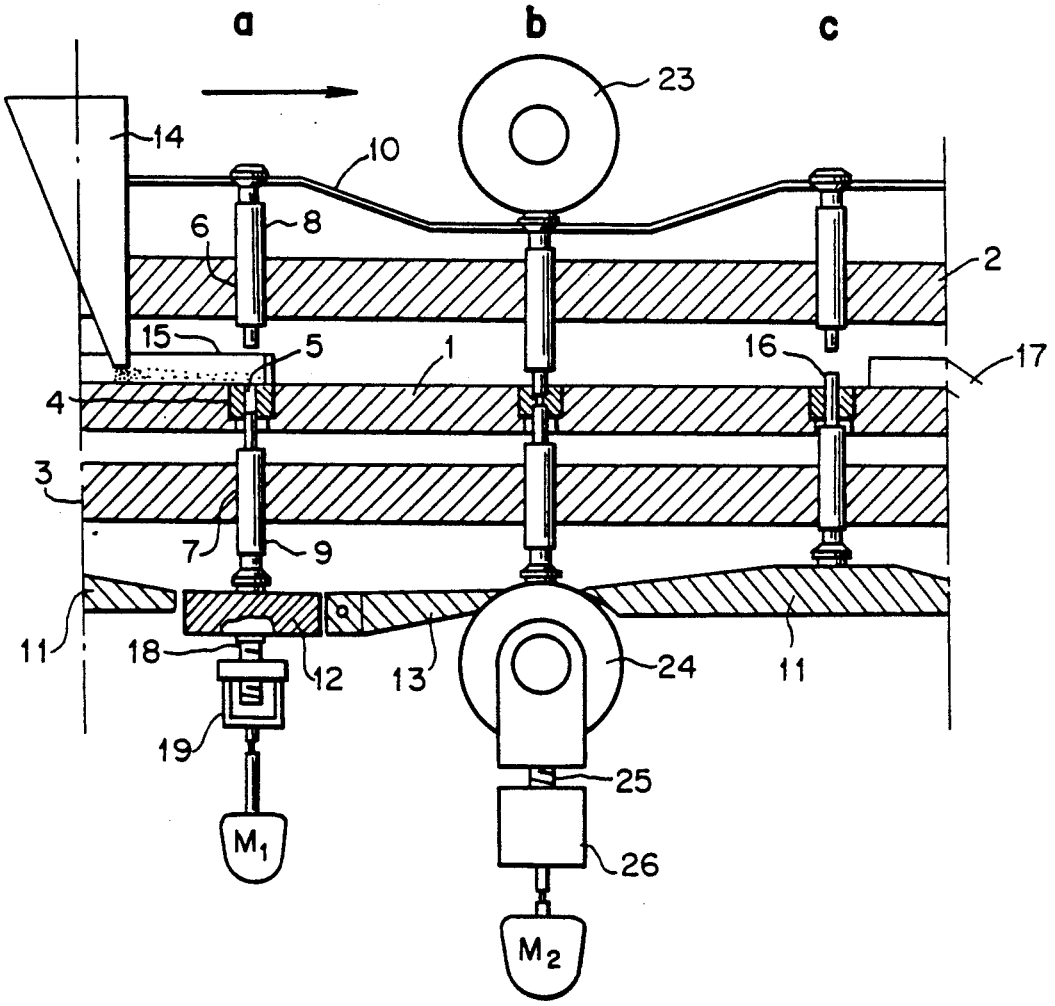

This is a continuation-in-part of application Ser. No. 088,815, filed Aug. 24, 1987, for Method of Quality Assurance In The Manufacture of Tablets, now abandoned.

The present invention relates to a method of assuring the manufactured quality of tablets such as drugs and, more particularly, for assuring that the weight of such tablets are proper.

In the manufacture of drugs in the form of tablets, the weight of the tablets must be maintained within prescribed limits. Thus, the tablets must be weighed for control purposes. Such weighing, however, is a relatively time-consuming operation and, therefore, the weighing of each individual manufactured tablet is not economically possible. Furthermore, even if the tablet weight is found to be incorrect, it would be too late to exercise any influence on the manufacture of the tablets if, for example, a tabletting machine produces 200,000 tablets per hour.

In practice, therefore, tablet weight is controlled indirectly. This method is based on the assumption that with the same volumetric filling of a matrix in which a tablet is compressed or molded, and compression to the same height of the fillet of the tablet, the compression force will be constant. This compression force can be continually measured during the course of manufacture, so that the compression force of each individual tablet can be determined and evaluated. Thus, manufactured tablets whose force of compression exceeds or falls short of the required tolerance can be sorted out individually. In addition, known tabletting machines have adjustment devices by which changes in compression force values are compensated for by altering the amount of the filling. However, determining the weight of tablets solely on the basis of the compression force so measured is inadequate. What is required rather, is to check at certain time intervals the relation between the compression force during manufacture and the weight of the tablets.

With known tabletting machines, this checking of compression force versus tablet weight is accomplished by taking samples of tablets, which are weighed. For this purpose, the actual weight of the tablets taken as samples, for example 20 tablets, is compared with the nominal weight for 20 tablets and recorded. These weights are considered as representative of a production quantity of, for example, 100,000 tablets. If the actual and nominal weights do not correspond, the tabletting machine is adjusted depending on the deviation from the mean value and the weight of the tablets is again adjusted to the nominal value.

However, this procedure, even with the possible sorting out of individual tablets, does not guarantee that the produced tablets do not contain a single tablet with significant weight deviation. The few "runaways", that is, tablets whose weight deviates significantly from the weight cf other tablets, have little bearing on the quality of the production lot of, for example, 100,000 tablets, since they do not significantly influence either the statistical mean value or the relative standard deviation.

Furthermore, it must be kept in mind that monitoring the production of tablets by controlling the production compression force presupposes that the matrices have the same amount of filling and that material with constant quality is used in order to arrive at constant results. In practice, however, variations occasionally occur in the quality of the material, which have no direct effect on the compression force, but do have an effect on the weight of the tablets. Therefore, checking tablet weight by sampling is beneficial for keeping the weight tolerance as low as possible within predetermined limits.

A problem arises if the sample of 20 tablets happens to contain one or several "runaways", since this will result in an incorrect reading for the entire associated production lot of 100,000 tablets and show it to be poorer than it actually is. Furthermore, the disadvantages are particularly serious if the mean value of the weight of the sample tablets is also incorrect as a result of such "runaways" and is used for adjusting the tabletting machine. In this case the assumed error will in fact occur in the next production lot but in a reversed form. For example, if a sample of 20 tablets is taken and this sample contains an error tablet or "runaway" by whose higher weight the mean value of the 20 tablets is caused to be 1% higher than with 20 flawless tablets, and if the tabletting machine is accordingly adjusted to a mean value that is 1% lower than before, all subsequently produced 100,000 tablets will each deviate from the nominal weight by 1%.

It is, therefore, an object of the present invention to provide a method for assuring the quality of manufactured tablets that overcomes the problems associated with the methods indicated above.

This object is accomplished in accordance with the present invention wherein, prior to adjusting the tabletting machine, the weights of the individual tablets of the sample are measured and compared. If the weights of one or several of the tablets of the sample are found to significantly deviate from the nominal weight therefor, then the statistical analysis is corrected by corrective computation and the corrected value used for adjustment of the tabletting machine.

By this procedure, the tablets of the sample lot are controlled by checking such tablets for runaways with weight values significantly deviating from the weights of the other tablets, so that such runaways are eliminated from the calculation and are not taken into account for any adjustment of the tabletting machine that would be inaccurate because of such runaways. Adjustment would therefore take place only if the weight of a plurality of tablets of the sample is found to exceed a certain limit or fall short of a certain limit. Also, adjustment may take place if the tablets have a weight which, between two tolerance limits, closely approaches one limit. Irrespective thereof, the compression force is also continually monitored.

For example, if, as a sample lot, 20 tablets are taken wherein each is to have a weight of 1 gram, and if of these 20 tablets, 19 weigh 1 gram each and one tablet weighs 1.1 grams, this would lead to a mean value exceeding the nominal value by 0.5%, or 5 mg per tablet If this single tablet were not eliminated from the corrective computation, the subsequently produced tablets would each weigh 5 mg below their nominal weight. In other words, disregarding the runaway, that is, an adjustment without correcting the calculation would mean that the subsequently produced tablets would fall short of the nominal weight by 5 mg. The computer used for the evaluation and documentation of the results may disregard the individual "runaway" tablet, or it may take it into account with a fraction of its value in accordance with known methods of statistical calculation. Subsequently, one must determine whether the resulting mean value requires adjustment or not.

If only one or only a few runaways are found in the sample lot depending on the size of the sample, the statistical error that may result therefrom may be corrected by suitable corrective computations. For example, the Shapiro-Wilks-Test or Nalimov-Test, which are known methods of statistical calculation, may be employed and the corrected values used for the adjustment of the tabletting machine and documentation. Otherwise the entire sample is discarded and a new sample is taken immediately, which preferably includes twice as many tablets, and evaluated accordingly. If a relatively high number of runaways are found, a new sample with basically twice as many tablets is taken.

If the sample is twice as large as the preceding one, the probability with respect to the number of runaways present in the sample is greater. In this connection, one must take into account that if many runaways appear within a sample, the cause may be a momentary operating problem or failure such as, for example, a temporary bridging of the outlet hopper or funnel through which the feed stock or fitting is continually admitted into the matrices.

Preferably, controlling the weight and any corrective computations that may be required, or the determination as to whether a second sample is required is automatically handled by a computer. This same computer also carries out the statistical evaluations and the data output thereof is automatically used for adjustment of the tabletting machine, if required, and for a documentation of the values so determined.

The accompanying drawing shows an example of a powder compression molding machine showing the means of adjusting weight and thickness of molded goods.

In the drawing, in order to show the operating condition of the punches, the turntable, etc. are represented in longitudinal section along the circumference where the punches are disposed, the imaginary cylindrical surface along said circumference being developed in a plane.

Referring to the drawing, a turntable 1, an upper punch guide block 2 and a lower punch guide block 3 are formed in one piece, and rotate around a rotary shaft of the powder compression molding machine.

Along a fixed circumference on the surface of turntable 1, a number of stepped holes (in the drawing 3 holes are shown) are bored at equal space, and in these stepped holes are fitted bushes 4, inside which are formed molding chambers, i.e., dies 5. The bottom of dies 5 is formed by the upper end of the lower punch 9 described hereinafter.

In said upper punch guide block 2 and lower punch guide block 3 are formed respectively holes 6 and 7 in the position corresponding to the position of dies 5 of said upper turntable 1, and in hole 6 an upper punch 8, and in hole 7 a lower punch 9 are slidably fitted.

Upper punch 8 moves toward the right in the drawing with its head suspended by an upper punch guide rail 10 disposed above upper punch guide block 2. On the other hand, lower punch 8 moves toward the right in the drawing, sliding on the surface of a lower punch guide rail 11, a weight rail 12 and a guide rail 13, which is rotatably attached to the end of weight rail 12 with a pin.

Above turntable 1 are disposed a hopper 14 containing powder, a feed chute 15 to feed powder that falls from hopper 14, little by little into dies 5, and a chute 17 to take out molded goods.

In the drawing "a" is the position where weight is adjusted, "b" is the compression molding position as well as the position where thickness of the molded goods is adjusted, "c" is the position where the molded good are taken out.

At position "a", at the lower end of weight rail 12 is attached a screw bar 18, which is screwed into a rotary nut 19 which is attached to the upper end of the shaft of a primer mover M1, for adjusting weight.

Now, weight of the molded goods is determined by the volume of the dies 5 at position "a", and this volume of the dies 5 is determined by the depth of the dies 5, so that ultimate weight can be adjusted by lifting and lowering weight rail by prime mover M1 for adjusting weight.

At position "b", above or below upper punch 8 and lower punch 9 are disposed respectively compression upper roll 23 and compression lower roll 24, and at the lower end of compression lower roll 24 is attached screw bar 25, which is screwed into a rotary nut 26 which is attached to the upper end of the shaft of a primer mover M2 for adjusting thickness.

Thickness of the molded goods is determined by the space between upper punch 8 and lower punch 9 at position "b", so that this thickness can be adjusted by lifting and lowering compression lower roll 24 by primer mover M2 for adjusting thickness.

At position "c", lower punch 9 which is pushed up by lower punch guide rail 11 pushes up molded goods 16 on to the plane of the upper surface of turntable 1, and molded goods 16 is taken out by chute 17.

While only a single method according to the present invention has been described, it will be obvious that many changes and modifications may be made thereunto without departing from the spirit and scope of the invention.

What is claimed is:

1. In a method of assuring the quality of tablets manufactured in a tabletting machine having an upper and a lower tablet punch to a nominal weight comprising, sampling the actual weight of a plurality of tablets during manufacture, calculating the mean weight of the sampled tablets, comparing the mean weight of the sampled tablets to the nominal weight to determine a deviation, adjusting the tabletting machine by lowering or raising the lower tablet punch according to the deviation in order to adjust the actual weight of the tablets to the nominal weight, the improvement comprising:

correcting the mean weight of the sampled tablets by corrective computation by means of the Shapiro-Wilks test or Nalimov test when the actual weight of one or several tablets of the sample is found to significantly deviate from the nominal weight and using the corrected mean weight as the mean weight when comparing the mean weight to the nominal weight.

2. The method according to claim 1, which further comprises the step of taking and evaluating another sample before the tabletting machine is adjusted, if the weight of one or several tablets of the initial sample is found to significantly deviate from the nominal weight and the entire sample is not used for adjustment.

3. The method according to claim 2, wherein, as an additional sample, a sample is taken whose number of tablets is a multiple of the number of the first sample.

4. The method according to claim 1, wherein correcting the mean weight of the sampled tablets as well as an automatic corrective computation or determination of a requirement of a second sample is accomplished by a computer whose data output is connected to a device for adjusting the amount of feed stock.

* * * * *